US008091306B2

(12) United States Patent
Kerrels

(10) Patent No.: US 8,091,306 B2
(45) Date of Patent: Jan. 10, 2012

(54) LIGHTWEIGHT METAL JOINT FOR CONCRETE SURFACES

(75) Inventor: Pierre Raymond Kerrels, Bousval (BE)

(73) Assignee: Plakabeton S.A., Ternat (BE)

( * ) Notice: Subject to any disclaimer, the term of this patent is extended or adjusted under 35 U.S.C. 154(b) by 812 days.

(21) Appl. No.: 11/596,738

(22) PCT Filed: May 11, 2005

(86) PCT No.: PCT/BE2005/000073

§ 371 (c)(1),
(2), (4) Date: Aug. 20, 2008

(87) PCT Pub. No.: WO2005/111307

PCT Pub. Date: Nov. 24, 2005

(65) Prior Publication Data

US 2009/0007512 A1 Jan. 8, 2009

(51) Int. Cl.

| | |
|---|---|
| ***E04B 1/68*** | (2006.01) |
| ***E04B 1/682*** | (2006.01) |
| ***E04F 15/14*** | (2006.01) |

(52) U.S. Cl. ..... 52/396.05; 52/396.02; 52/396.04

(58) Field of Classification Search ..... 52/396.02, 52/396.04, 396.05, 393, 395, 586.1, 582.1; 404/87, 88, 47

See application file for complete search history.

(56) References Cited

U.S. PATENT DOCUMENTS

| | | | | |
|---|---|---|---|---|
| 4,012,024 | A | 3/1977 | Courtois | |
| 4,021,984 | A * | 5/1977 | Honegger | 52/471 |
| 4,804,292 | A * | 2/1989 | DeLuca | 404/69 |
| 6,354,053 | B1 * | 3/2002 | Kerrels | 52/396.04 |
| 6,775,952 | B2 * | 8/2004 | Boxall et al. | 52/396.05 |
| 2003/0033778 | A1 * | 2/2003 | Boxall et al. | 52/396.02 |

FOREIGN PATENT DOCUMENTS

| | | |
|---|---|---|
| EP | 1 389 648 A1 | 2/2004 |
| WO | WO 99/55968 | 11/1999 |

* cited by examiner

*Primary Examiner* — Eileen D Lillis
*Assistant Examiner* — Andrew Triggs
(74) *Attorney, Agent, or Firm* — Hoffmann & Baron, LLP

(57) ABSTRACT

A metal joint for concrete slabs including means of separating the slabs and means allowing the horizontal movement of slabs relative to each other while avoiding vertical movement between the edges of the slabs, the metal joint comprising a first part incorporated in a first slab, comprising a vertical web with an upper edge and provided with a series of tenons which extend horizontally towards the exterior of the slab and a second part incorporated in a second slab comprising in its upper section a web with an upper edge and a series of mortise elements which extend towards the interior of the slab and are arranged opposite the tenons so that they can engage with each other, wherein the upper edges of the webs terminate at the top by an upper sharp edge strengthened by a cold-rolled fold so as to form a right angle on the outer side of the slab and a sharp edge with an acute angle in contact with the concrete of the slab thus forming a smooth upper surface and a sharp edge of the joint of the adjacent slabs.

9 Claims, 4 Drawing Sheets

Fig. 1
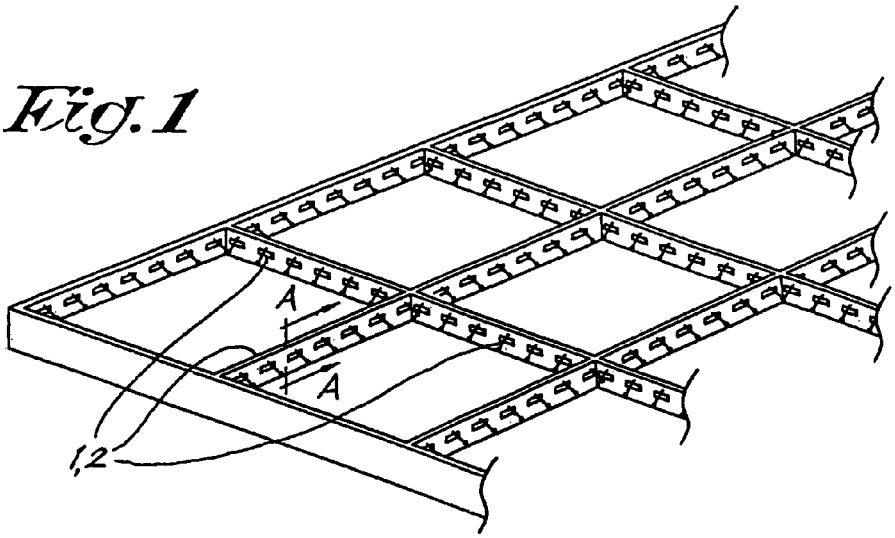
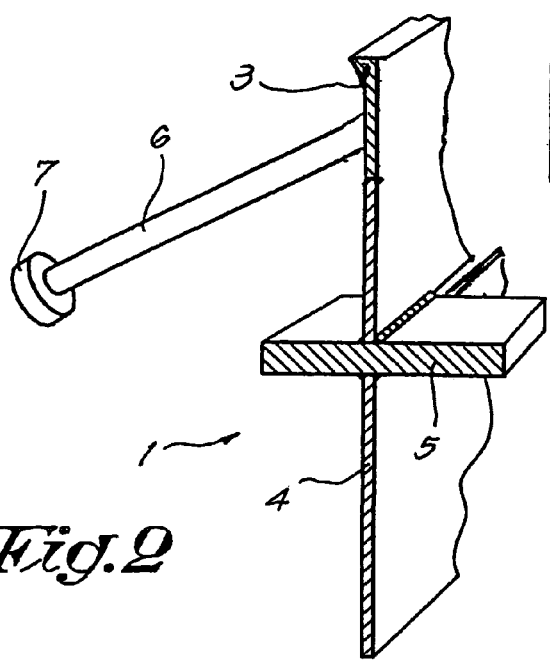
Fig. 2
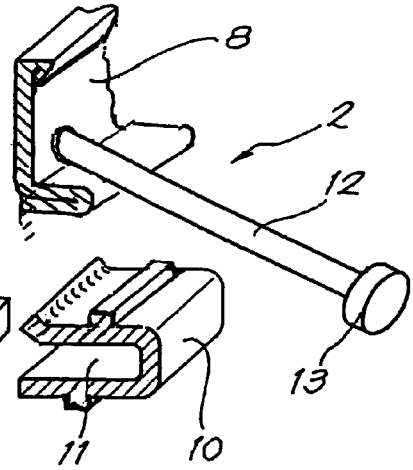
Fig. 3

LIGHTWEIGHT METAL JOINT FOR CONCRETE SURFACES

This application is the U.S. National Phase of, and Applicant claims priority from, International Application Number PCT/BE2005/000073 filed May 11, 2005 and Belgium Patent Application bearing Serial No. BE 2004/0252 filed May 19, 2004 which are incorporated herein by reference.

BACKGROUND OF THE INVENTION

The present invention concerns the creation of concrete surfaces and more particularly the metal joint used to this effect in order to demarcate the slabs.

In making large concreted areas, the surface is divided into rectangular or square sections constituting the slabs of concrete. This division is generally achieved using metal profiles that demarcate each concrete slab and form the joints between slabs.

Advantageously, the joints are provided with means of absorbing the variations in dimensions of the slabs caused by temperature variations. These joints must also be able to absorb heavy loads while the correct level of the surface of the slabs and avoiding any degradation of the edges of the concrete slabs.

To this end, the joints must meet the following criteria:

- offer efficient protection for the sharp edges of the concrete slabs;
- guarantee positive anchoring in order to avoid any risk of separation from the slab;
- allow the use of a sufficient thickness of material to avoid shearing of the slab due to weak points cased by the profile of the joint;
- allow removal or expansion of the slabs by means of mortise and tenon interlocking, that also ensures that the level of the slabs is maintained.

In general, these joints for concrete slabs are made from sheet steel profiles and more particularly of the double profile type with male and female interlocking such as mortise and tenon which allows expansion of the slabs and resists vertical displacements when heavy loads are applied.

A joint commonly used is made from a double profile of a material in the shape of an omega, in which the external shape of one matches the internal shape of the other. The male central part of the joint must necessarily present a sufficient volume to allow it to be filled with concrete when it is cast.

For a constant slab thickness and in the case where the upper part of the joint has to be augmented for reasons concerning its ability to transfer heavy loads, the lower part of the joint automatically becomes insufficient and as a result is no longer able to tolerate these loads because of lack of thickness of the matrix. As a consequence of this it is necessary to have numerous models of joint of different heights.

Another problem encountered with this type of profile is that, when the height of the concrete slab is limited, the minimum dimensions of the omega-shaped profile remain nevertheless very large because of the volume necessary for the central (male) part of the joint. As a result of this the mass of concrete that remains in the upper part of the edge of the slab, situated above the interlocking of the profile, is highly insufficient to be able to withstand the normal (vertical) loads on the surface of the slab and, consequently, this part is exposed to deterioration by cracking or spalling of the concrete.

At the present time joints are available with male and female interlocking offset below the median line of the slab in order to obtain a greater thickness of material above the interlock with a view to procuring greater strength for loads on the edges of the slabs.

Document WO 99/55968 also describes a structural joint for concrete slabs comprising, firstly, an L-shaped female profile of which the vertical wing extends along the length of the edge of the slab and as far as the upper edge of the latter and of which the double horizontal wing extends towards the interior of the slab and, secondly, an L-shaped male profile of which the vertical wing also extends along the length of the edge of the slab and as far as the upper edge of the latter and of which the horizontal wing extends towards the exterior of the slab so as to be able to engage with the female profile of the adjacent slab.

The problem encountered with this type of profile is that it is rolled in continuous lengths and, when it is placed in the concrete, it cuts the thickness of the slab into two parts in the vicinity of the joint. At this position there remains only half the thickness of the slab on either side of the male and female profile, which causes incipient failures in the longitudinal direction of the slab.

Although this joint offers good strength against vertical loads, one nevertheless observes incipient cracking at the extremities of the horizontal portions of the profiles due to the fact that these joints extend continuously over the whole length of the concrete slab while weakening the edges of the concrete. In effect, the thickness or height of the concrete slabs is calculated to withstand maximum vertical loads but the edges of the slabs no longer have all the height necessary to withstand these loads, given that they are interrupted over all of their length by the horizontal wing of the profile of the joint.

Another problem with this type of joint is that it offers only limited strength against deformations of the thin edge of the concrete slab, given that the thickness of the profile that extends as far as the upper surface remains limited to the thickness of the sheet metal forming the profile. It is important to use joints which procure efficient strengthening of the upper edge of the concrete slabs.

In general, structural joints for concrete slabs include firstly an L-shaped female profile of which the vertical wing extends along the length of the edge of the slab and as far as the upper edge of the latter and, secondly, an L-shaped male profile of which the vertical wing also extends along the length of the edge of the slab and as far as the upper edge of the latter, extending continuously over the whole length of the slab.

These two profiles are assembled facing each other so as to form the reinforced lips of the concrete slabs to be joined. These metal joints are heavy and expensive.

SUMMARY OF THE INVENTION

The purpose of the present invention is to provide remedies for the above-mentioned disadvantages by simple and effective means that will be described in more detail below.

To this effect the joint according to the present invention is made from thinner sheet metal, strengthening the upper edge of the male and female profiles by folding the sheet metal on itself and compressing this doubled part by mechanical means for cold rolling in order to obtain a greater width of the edge with sharp corners and thus obtain an ideal shape of this edge in other words obtain a right angle on the external side of the slab and an edge with an acute angle on the concrete side.

This geometry therefore gives to the upper edge of the concrete slab, in contact with the metal edge, an obtuse angle which supports the edge when large loads are applied to the edge.

To this effect the metal joint according to the invention is produced in accordance with the characteristics such as described in the appended claims.

BRIEF DESCRIPTION OF THE DRAWINGS

In order to ensure correct understanding of the invention, an example of implementation is described in the following description in which one refers to the appended drawings in which:

FIG. 1: shows the preparation of part of a surface to be concreted using an assembly of joints according to the invention;

FIG. 2: shows a perspective detail of a first part of the joint according to the invention including male components;

FIG. 3: shows a perspective detail of a second part of the joint according to the invention including female components;

DETAILED DESCRIPTION OF THE PREFERRED EMBODIMENT

Figure 4:
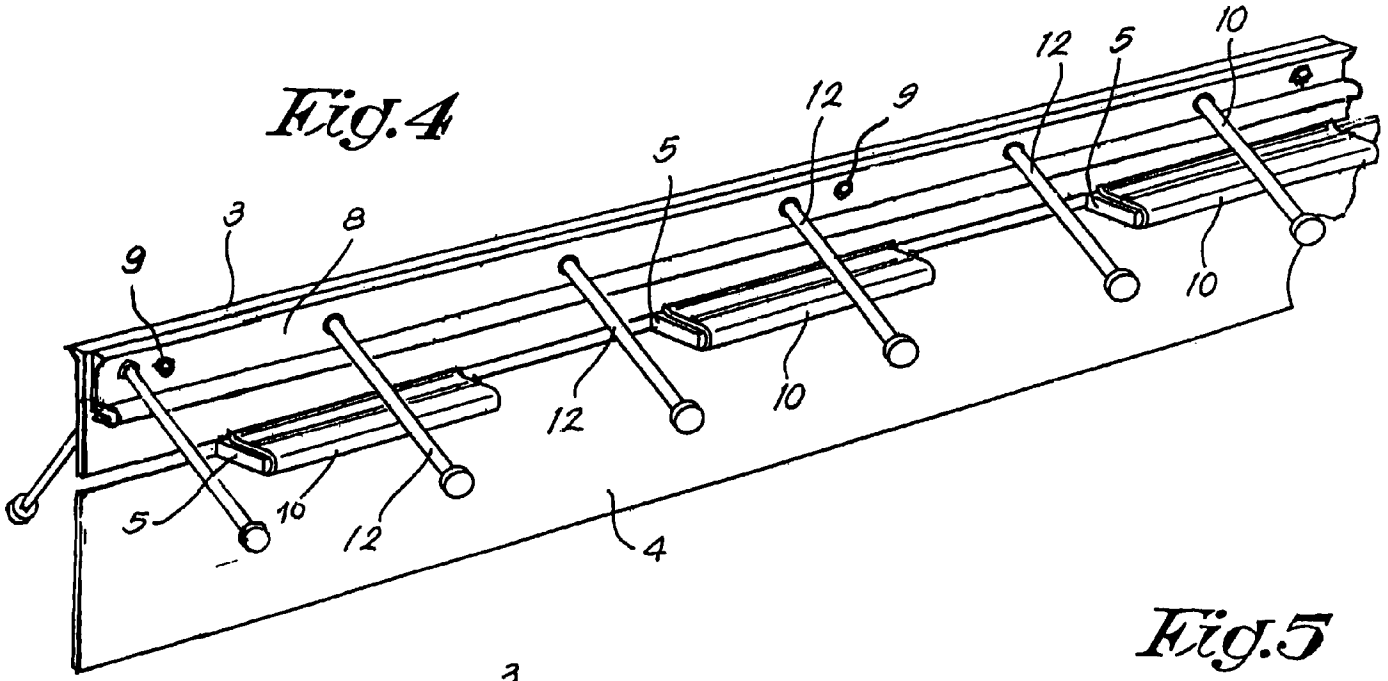
FIG. 4: is a perspective view of an assembly of the two parts according to the invention before the concrete is poured.

In FIG. 1 we show an assembly of joints, comprising the male parts 1 and the female parts 2, dividing the surface to be concreted into square or rectangular sections or slabs.

FIGS. 2 and 3 show the details of the joint in the vertical section A-A of FIG. 1.

The first male part 1 is made from a sheet of steel 3 folded on itself along its upper edge and cold rolled in order to form the edge.

A series of pins 6 with a head or enlargement 7 at their ends is provided on one of the lateral faces of the sheet metal 3 oriented towards the interior of part 1 of the joint. These pins 6 extend slightly downwards at a sufficient angle to allow effective engagement of the part 1 in the mass of the concrete.

A series of tenons 5 which extend in substance horizontally on either side of the sheet metal 3 are welded at regular intervals to the lower edge of the sheet metal 3.

Beneath the tenons 5 is provided a second vertical sheet of metal which extends downwards in substance as far as the lower part of the slab. The thickness of this sheet metal 4 can be slightly less than that of the sheet metal 3, given that it serves only to separate the two adjacent concrete slabs.

The second part 2 of the joint according to the invention is shown in FIG. 2 and is composed of a longitudinal sheet of metal 8, similar to the sheet metal 3 of the first part 1. The height of this sheet metal 8 is limited relative to the sheet metal 3 and the lower extremity is folded on itself in an L shape oriented towards the interior of the part 2.

A series of pins 12 with a head or widening 13 at their ends is provided at regular intervals on one of the lateral faces of the sheet metal 8 oriented towards the interior of part 2 of the joint. These pins 12 extend slightly downwards at a sufficient angle to allow effective anchoring of the part 2 in the mass of the concrete.

The part 2 also includes a series of mortises 10 in the shape of a U of which the opening 11 is designed to receive the tenons 5 of the male part 1. This opening 11 is preferably provided with a tapered entrance to facilitate insertion of the tenon 5. The external surface of the mortises is provided with keying ridges for the concrete. Before the concrete is poured these mortises 10 are pushed onto the external parts of the tenons 5. The mortises are advantageously made from plastic.

In FIG. 4 we show a section of joint assembled before the concrete is poured with the second part 2 of the joint engaged with the part 1 by means which can break on the subsequent contraction of the adjacent slabs. These means can be plastic bolts or rivets 9.

The two sheet metal parts 3 and 8 are juxtaposed and their upper folded surfaces form the edges of the concrete slabs. One can also see the arrangement of the series of mortises 10 pushed onto the corresponding tenons 5 and the pins 12.

Figure 5:
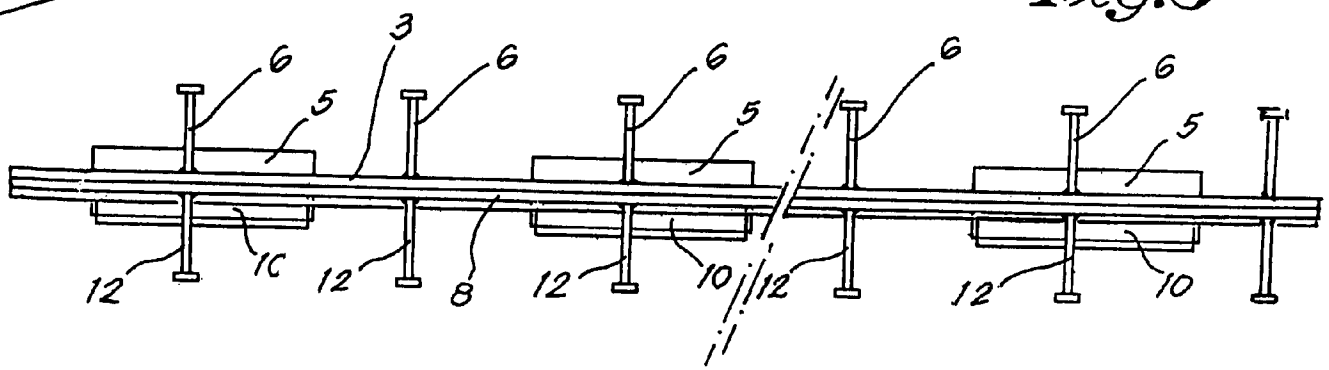
FIG. 5: is a plan view of the assembly shown in FIG. 4.

FIG. 5 is a plan view corresponding to FIG. 4 in which one can also see the internal part of tenons 5 extending beyond the sheet metal 3 and the series of pins 6 of the first part 1.

The joints according to the invention are employed in the following manner:

When the joints 1 and 2 are assembled as illustrated in FIG. 1, the concrete is poured into each section demarcated by the joints 1 and 2 in order to form a surface of concrete slabs.

The concrete is poured until it reaches the level of the upper edges of the metal sheets 3 and 8.

At this point the concrete will have flowed on either side of the separation 4 and will have enveloped the pins 6 and 12 and the parts of the tenons on one side of the separation and the mortises on the other side of the separation.

Figure 6:
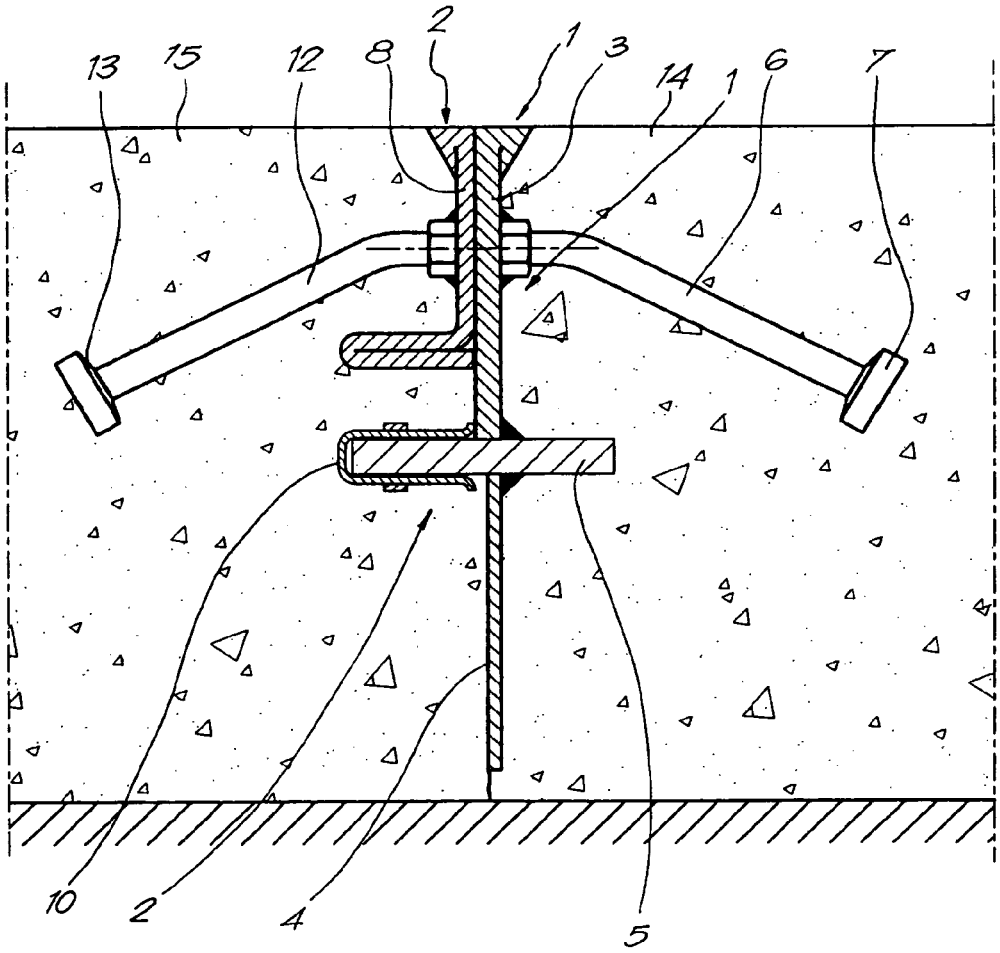
FIG. 6: is a vertical sectional view of the metal joint after the concrete is poured.

After hardening one thus obtains a joint such as is shown in FIG. 6, where one can see the edge of a first slab 14 incorporating the first part 1 of the joint and the edge of a second slab 15 incorporating the part 2 of the joint according to the invention.

In the event of shrinkage, the provisional means of fixing 9 of the metal sheets 3 and 6 will break and the slab 15 will then be able to separate completely from the slab 14 and move slightly to the left thanks to the movement of the tenons 5 of the slab 14 inside the mortises 10 of the slab 15. This movement will occur much more smoothly and without jamming or retention by rusted parts, thanks to the plastic mortises 10.

The vertical loads applied on the upper surface of the joint according to the invention will be evenly spread over the two edges of the slab and vertical displacements will be avoided by the tenons 5 and the strength of the upper edges of the concrete is increased thanks to the obtuse angles $\alpha$ of the upper corners.

The parts of the slabs situated between the pieces of the tenons 5 and the mortises 10 will also permit the transmission of large loads without excessive play at the joint. In effect, these parts conserve the total thickness of the slab and thus avoid to the maximum degree cracks and incipient failure in the longitudinal direction in the vicinity of the joint.

Figure 7:
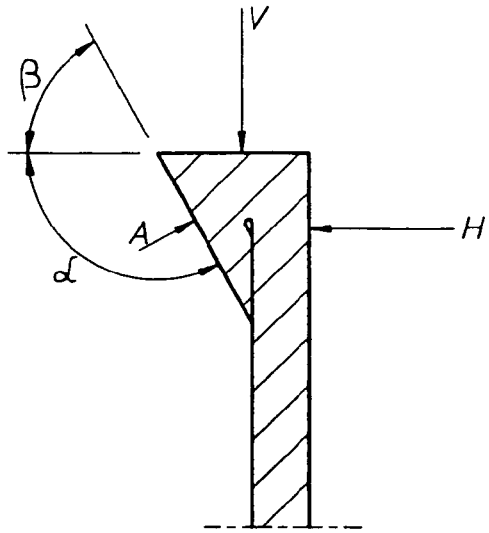
FIGS. 7, 8 and 9: show in detail the implementation of the upper part of the metal joint according to the invention.

FIG. 7 shows in detail the making of the upper edge of the steel sheets 3 and 8.

As already described above, this edge is folded on itself over its whole length and then cold rolled. A set of three rollers is used for this purpose in which the first acts in a horizontal plane H, the second in a vertical plane V (90° angle) and the third in an oblique plane A situated at an acute angle relative to the roller V and therefore leaving an obtuse angle $\alpha$ relative to the upper surface of the concrete. This angle $\alpha$ should preferably be obtuse in order to give greater strength to the edge of the concrete slab.

Figure 8:
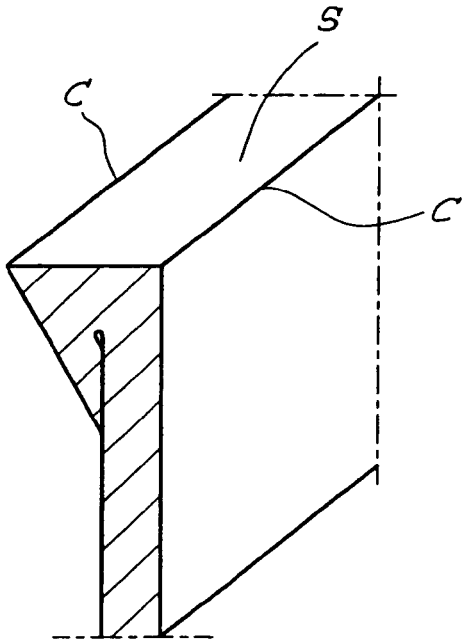

FIG. 8 shows the upper edge of part of the joint thus obtained which presents sharp corners C and a smooth upper surface S thanks to cold rolling and cold hardening. The upper edge of the joint according to the invention is thus made from sheet steel with a thickness of 3 to 4 mm of which the upper edges are folded onto themselves and then cold rolled so as to obtain a smooth upper surface having a width of 8 to 12 mm with sharp corners in steel hardened by cold deformation to roll the material and make it stronger.

Figure 9:
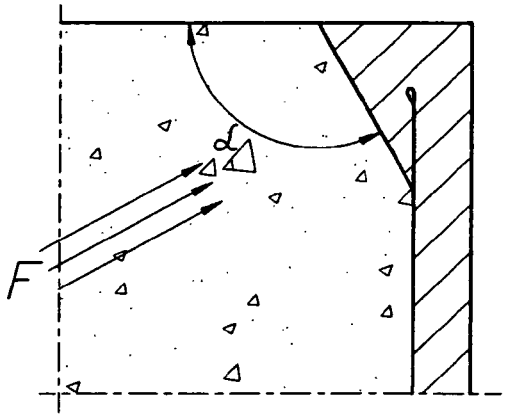

FIG. 9 shows a corner of a concrete slab fitted with part of the joint according to the invention. The shape thus acquired by the concrete when poured gives it greater resistance F to spalling thanks to the obtuse angle $\alpha$ at the most critical point.

Thanks to the invention one now obtains a joint for concrete slabs of which the weight and therefore the cost is greatly reduced relative to existing joints.

Another advantage of the joint according to the invention is that the quantity of steel required is greatly reduced while providing reinforced and rectilinear thin edges due to the fact that they can be made from thin steel sheet of which one edge is folded on itself and cold rolled, which gives it a shiny appearance and greater strength when thus compressed in comparison to sheared thick sheet steel of rough section or a flat rolled steel.

The present description corresponds to an example of implementation but other forms of implementation remain possible without leaving the framework of the present invention.

The invention claimed is:

1. A metal joint for concrete slabs including means of separating the slabs and means allowing the horizontal movement of slabs relative to each other while avoiding vertical movement between the edges of the slabs, the metal joint comprising:

a first part incorporated in a first slab comprising a vertical web made of a sheet metal, the vertical web of the first part having an outer face and an upper edge and being provided with a series of tenons which extend horizontally towards the exterior of the first slab and a second part incorporated in a second slab comprising in its upper section a web made of a sheet metal, the vertical web of the second part having an outer face facing the outer face of the vertical web of the first part, an upper edge and a series of mortice elements which extend towards the interior of the second slab and are arranged opposite the tenons of the first slab so that the series of tenons and mortice elements can engage with each other, wherein the upper edge of each of the first and second vertical webs consists of a folded end portion of the sheet metal folded on itself terminating at the top by a smooth horizontal surface forming a right angle with the respective vertical web, the folded end portion terminating at the top by the smooth horizontal surface extending between a sharp corner forming the right angle and a sharp edge forming an acute angle with the folded end portion folded on itself, the folded end portion being cold rolled and contacting the concrete of the slab.

2. A joint according to claim 1, wherein the second slab has an upper edge in contact with the upper edge of the vertical web of the second part, the upper edge of the second slab having a face contacting the folded end portion of the metal sheet fold on itself, the concrete face forming an obtuse angle and supporting the upper edge of the slab when the joint is subjected to large loads.

3. A joint according to claim 1, wherein the width of the smooth horizontal surface of the upper edge of each vertical web is more than twice the thickness of the sheet metal of the respective vertical web.

4. A joint according to claim 3, wherein the mortice elements are made of plastic material and are captive in the concrete of the second slab.

5. A joint according to claim 1, wherein each tenon extends on either side of the vertical web of the first part so that one part extends towards the inside of the first slab and the other part extends towards the outside of the first slab.

6. A joint according to claim 1, wherein the mortice elements of the second part present in substance a U shape in order to create an opening which can engage with the corresponding tenons of the first part of the joint.

7. A joint according to claim 1, wherein the vertical webs of the first and second parts have a series of anchoring pins in the concrete of respectively the first slab and the second slab.

8. A joint according to claim 7, wherein the pins are fixed at regular intervals on the vertical webs, the extremities of the pins being provided with an enlargement or head.

9. A joint according to claim 1, wherein the first part of the joint is extended downwards by sheet metal that extends vertically down, in substance as far as the lower part of the slab.

* * * * *